United States Patent [19]

Ronden

[11] Patent Number: 4,539,100

[45] Date of Patent: Sep. 3, 1985

[54] METHODS FOR REMOVING PARTICULATE SOLIDS AND WATER FROM PETROLEUM CRUDES

[75] Inventor: Clifford P. Ronden, Edmonton, Canada

[73] Assignee: Husky Oil Operations Ltd., Alberta, Canada

[21] Appl. No.: 552,865

[22] Filed: Nov. 17, 1983

Related U.S. Application Data

[63] Continuation of Ser. No. 397,696, Jul. 13, 1982, abandoned.

[51] Int. Cl.[3] ..... C10G 33/00; C10G 33/04

[52] U.S. Cl. ..... 208/188; 210/708; 210/724; 210/727; 210/728

[58] Field of Search ..... 208/188; 210/708, 724, 210/727, 728

[56] References Cited

U.S. PATENT DOCUMENTS

| | | | |
|---|---|---|---|
| 3,585,148 | 6/1971 | Sackis | 210/708 |
| 3,838,045 | 9/1974 | Clayfield et al. | 210/728 |
| 4,040,955 | 9/1977 | Davidson | 210/724 |
| 4,058,453 | 11/1977 | Patel et al. | 208/188 |
| 4,154,698 | 5/1979 | Doft | 210/708 |
| 4,216,079 | 8/1980 | Newcombe | 208/188 |
| 4,235,712 | 11/1980 | McClaflin | 210/708 |
| 4,261,812 | 4/1981 | Newcombe | 208/188 |
| 4,302,326 | 11/1981 | Bialek | 208/188 |
| 4,374,734 | 2/1983 | Newcombe | 208/188 |

FOREIGN PATENT DOCUMENTS

| | | | |
|---|---|---|---|
| 280526 | 7/1963 | France | 208/188 |
| 1533508 | 8/1968 | France | 210/708 |
| 0137557 | 12/1978 | Japan | 210/708 |
| 0047105 | 4/1980 | Japan | 210/708 |
| 263793 | 12/1968 | U.S.S.R. | 208/188 |
| 340281 | 5/1970 | U.S.S.R. | 208/188 |
| 412225 | 7/1970 | U.S.S.R. | 208/188 |

OTHER PUBLICATIONS

Encyclopedia of Surface Active Agents, vol. 11, J. P. Sisley Che, 1964, pp. 54–57, 88–95, 124–127 & 138–147.

Synthetic Detergents, 6th Ed., A. Davidson, Bill Milwidski, pp. 11–17, 24–27.

Anionic Surfactants, Part II, Warner, In. Linfield Editor, pp. 315–325.

*Primary Examiner*—D. E. Gantz

*Assistant Examiner*—Helane Myers

*Attorney, Agent, or Firm*—Roylance, Abrams, Berdo & Goodman

[57] ABSTRACT

Removal of particulate solids and water from petroleum crudes to bring the BS&W content of the crude within pipeline specifications is accomplished with the aid of a demulsifier comprising an anionic surfactant soluble in oil, a nonionic surfactant insoluble in water and dispersible in oil, and a cationic surfactant soluble in water, the anionic surfactant being in a major proportion, the nonionic and cationic surfactant being in lesser proportions.

6 Claims, No Drawings

METHODS FOR REMOVING PARTICULATE SOLIDS AND WATER FROM PETROLEUM CRUDES

This is a continuation of application Ser. No. 397,696 filed July 13, 1982 now abandoned.

This invention relates to the removal of particulate solids and water from petroleum crudes in order to bring the BS&W content of the crude to pipeline specifications. While applicable to all petroleum crudes which have a BS&W content in excess of pipeline specifications and which are characterized by containing a water-in-oil emulsion, the invention offers special advantage in the treatment of heavy oil crudes produced by enhanced oil recovery methods, particularly including fireflood crudes and other thermally produced crudes.

RELATED APPLICATIONS

Subject matter disclosed in this application is also disclosed and claimed in copending applications Ser. No. 397,935, now abandoned in favor of continuing application Ser. No. 522,551, filed Aug. 12, 1983, filed concurrently herewith by Clifford P. Ronden and Donald C. Roylance, and Ser. No. 397,934, filed concurrently herewith by Clifford P. Ronden and now U.S. Pat. No. 4,466,885.

BACKGROUND OF THE INVENTION

As produced at the wellhead, crude oils contain substantial quantities of inorganic particulate solids and water, and it has long been standard practice to require that the combined solids and water (BS&W) content be reduced to a value not exceeding a stated small percentage before the crude is introduced into a pipeline or supplied to a refinery. Such reduction of the BS&W content is necessary both to minimize damage to pipeline and refining equipment from, e.g., corrosion and abrasive wear, and to minimize economic losses arising from transporting and processing the non-petroleum constituents making up the BS&W content. Though specifications vary among localities and refineries, a typical specification requires that the BS&W content of the crude not exceed 0.5% by volume.

The BS&W content of many crudes can be brought within specifications relatively simply and easily, as by gravitational separation and, when required, addition of various treating agents. However, the heavy oil crudes, and especially those produced by fireflooding or other thermal recovery practices, have presented a more serious problem and no completely satisfactory method has been available for reducing the BS&W content of such crudes. Such crudes are highly viscous, so that the raw crude must in all events be diluted with, e.g., a wide gasoline fraction, commonly called condensate, to achieve adequate fluidity for handling and treatment. Even thus diluted, however, simple settling operations, even for extended times, do not result in adequate separation of the water from the oil, and it is commonly recognized that a substantial part of the remaining water is present as the disperse phase of a stable water-in-oil emulsion. In many cases, attempts to break the emulsions in such crudes have met with little success, and much attention has been given to the emulsion breaking problem by workers in the field. Prior to the invention disclosed in this application and the related applications listed above, attempts to bring the crudes within pipeline specifications have centered mainly on the dilution of the crude, preliminary separation of a major portion of the free water from the diluted crude, and use of one or more treating agents, commonly called demulsifiers in the trade, intended to break the water-in-oil emulsion of the crude so that separation of the emulsified water and the particulate solids could be accomplished. Particularly in the case of the heavy oil crudes, and especially those produced by fireflooding or other thermal procedures, prior art efforts have met with little success. Thus, taking fireflood crudes from the Husky Aberfeldy field as an example, testing of all of the demulsifiers offered by oilfield service companies has failed to provide a successful treatment.

As disclosed in aforementioned copending application Ser. No. 522,651, it has been found that the water-in-oil emulsions of the difficulty treatable heavy oil crudes, such as the Aberfeldy fireflood crudes, appear not to be stabilized by clays or other particles heretofore blamed for the stability of the emulsions, since the water globules of the disperse phase of the emulsions tend to be small in comparison to the particle size of the clays, silica and like native particulates of the crude. As a result of that discovery, a method was developed for breaking such emulsions, using an agent such as ammonium bisulfite when the pH of the crude had been raised to at least 8, advantageously to at least 10, as by the addition of an aqueous solution of sodium hydroxide. That method has for the first time been successful in reducing to pipeline specifications the BS&W content of a wide range of heavy oil crudes, especially those produced from the Cretaceous reservoirs in the Western Canada sedimentary basin, including the Cold Lake, Lloydminster and Medicine River fields. Further, as described in aforementioned U.S. Pat. No. 4,466,885, it has been discovered that, once the emulsion of the crude has been destabilized, as by use of ammonium bisulfide at an elevated pH, reduction of the BS&W content can then be adied by use of one of the conventional demulsifiers, namely, that supplied by Champion Chemical Co., Edmonton, Alberta, Canada, as CHAMPION BX6079, though most conventional demulsifiers appear to be of no assistance. The demulsifier supplied as CHAMPION BX6079 is a proprietary composition believed to be based upon mixtures of aliphatic and aromatic glycols in xylene as a diluent, the compounds being polar, soluble in oil and exhibiting surfactant action at the interfaces between the disperse water globules and the continuous oil phase of the emulsion in the crude. Demulsifiers supplied under the trademarks TRETOLITE RP663 and TRETOLITE RP514 have also been found to offer assistance.

Since the conventional demulsifiers are relatively expensive and, with few exceptions, of little value in the treatment of heavy oil crudes, there is a continuing need for discovery of new, effective demulsifiers and methods to aid in treatment of crudes by, e.g., the methods disclosed in the aforementioned copending applications.

OBJECTS OF THE INVENTION

A general object of the invention is accordingly to provide an improved demulsifier and method employing the same for treatment of heavy oil crudes.

Another object is to provide a demulsifier and method capable of improving the separation of water and solids from the heavy oil crudes once the water-in-oil emulsion of the crude has been destabilized.

SUMMARY OF THE INVENTION

The invention is based upon the discovery that, if the water-in-oil emulsion of the petroleum crude is destabilized, separation of the resulting treated crude into at least a clean oil phase and a water phase, and recovery of the clean oil phase, can be improved if there is uniformly distributed through the crude a demulsifier comprising an anionic surfactant which is soluble in oil, a nonionic surfactant insoluble in water but dispersible in oil, and a cationic surfactant which is soluble in water, the anionic surfactant constituting the major active constituent of the demulsifier and the nonionic and cationic surfactants being present in smaller proportions.

DETAILED DESCRIPTION OF THE INVENTION

While generally applicable to petroleum crudes which have a BS&W content in excess of pipeline specifications and contain a substantial proportion of water in the form of the disperse phase of a water-in-oil emulsion, the invention is most advantageous for the treatment of the heavy oil crudes, especially those obtained by enhanced recovery procedures and particularly those obtained by fireflooding and steamflooding. Typical of the heavy oil crudes are those produced from the Cretaceous reservoirs in the Western Canada sedimentary basin, including the Cold Lake, Lloydminster and Medicine River fields. The Lloydminster crudes, including Husky Aberfeldy, Husky G.N.O.L. Golden Lake, Murphy Silverdale, Mobile-GC Kitscoty and Brascan Lindbergh, are specific examples of the heavy oil crudes for the treatment of which the invention is especially advantageous. Such crudes typically have an API gravity of 12–16, sometimes 10–18, a pH of 5.5–6.8, sometimes 4–8, and BS&W contents ranging to as much as 70% by volume. Though such crudes contain a substantial proportion of free water, i.e., water which separates reasonably promptly by simple gravitational settling, a substantial part of the water content is present as the disperse phase of a water-in-oil emulsion, with the water globules of the disperse phase being as small as 0.5–2.5 microns and in at least some cases containing some dispersed oil, so that the emulsion can be considered to be complex.

The invention requires that the crude be sufficiently fluid to exhibit an API gravity of at least 17, advantageously at least 20. Thus, for the relatively viscous heavy oil crudes it is necessary first to blend the crude with a compatible hydrocarbon diluent in order to raise the API gravity and this is best accomplished with a wide gasoline fraction (condensate) as the diluent. The amount of diluent employed depends upon the particular crude and is 20–50% of the volume of the resulting blend. Though the blending step can be carried out in the facility used for the remainder of the method, it is advantageous in some cases to employ as the starting material a plurality of blended crudes gathered from existing field installations so that the starting material is then a blend of crudes from different wells with the crudes pre-blended with, e.g., condensate. With heavy oil crudes, the blended crude usually has a BS&W content of 2–10% by volume and a pH of 5.5–6.5. Whether done in the field or as the first step of the method, the blended crude must be dewatered, advantageously by gravitational separation, typically accomplished in a conventional heater-treater, the oil phase being recovered as a blended crude of reduced water content. The free water separated from the crude as produced water can advantageously be used in the process, as described in detail in aforementioned U.S. Pat. No. 4,466,885.

In order to successfully employ the new demulsifiers according to the invention, it is necessary to at least destabilize the water-in-oil emulsion of the dewatered blended crude. Though this can be accomplished in any suitable fashion, best results with the heavy oil crudes are obtained, as described in detail in aforementioned application Ser. No. 522,651, by distributing through the dewatered blended crude an amount of at least one alkalyzing agent adequate to raise the pH of the blend to at least 8, advantageously to at least 10, and uniformly distributing through the crude an inorganic additive capable of acting directly on inorganic sulfur native to the crude. Such additives include the alkali metal, alkaline earth metal and ammonium monosulfides and hydrosulfides and agents, typically ammonium bisulfite and the hydrosulfites of alkali metals and alkaline earth metals, capable of reacting in the crude under the conditions of treatment to yield in situ monosulfides and/or hydrosulfides. For reasons of economy, ease of handling and effectiveness, it is advantageous to employ an aqueous solution of ammonium bisulfite as the inorganic additive to destabilize the emulsion, the concentration and amount of the solution being chosen to provide ammonium bisulfite in the range of 0.03–0.5% of the weight of the dewatered blended crude. In addition to the elevated pH, breaking of the emulsions of the heavy oil crudes with additives of the type referred to requires that the crude be at a temperature of 52°–88° C. for from a few minutes to a few hours while the additive is present. The dewatered blended crude can be heated initially and the temperature kept elevated throughout the process, or the heating step can occur at any time to and throughout the phase separation step.

The new demulsifiers employed according to the invention comprise an anionic surfactant which is soluble in the oil of the crude, a nonionic surfactant which is insoluble in water and dispersible in oil, and a cationic surfactant which is soluble in water. Advantageously, the anionic surfactant is at least one alkyl aryl sulfonate, in which the hydrophobic group is attached to a sulfonated aromatic nucleus directly or through an intermediate group; the nonionic surfactant is at least one glycol ester, advantageously ethylene glycol distearate; and the cationic surfactant is a quaternary ammonium halide in which nitrogen is attached to the hydrophilic group directly or through an intermediate group. The anionic surfactant is the predominant ingredient, constituting 5–20 parts by weight of the active material, while the nonionic and cationic surfactants are employed in smaller amounts, each in the range of 2–10 parts by weight. The composition is prepared with a liquid vehicle, typically xylene, which is compatible with the crude, and can be further extended with the same liquid or, e.g., kerosene distillate. The demulsifier is used in a proportion providing in the blended crude a total surfactant weight equal to 50–300 grams per barrel of blended crude being treated.

All additives employed in the method should be incorporated with the aid of continuous agitation to achieve a complete and uniform distribution of the additive throughout the blend, but agitation of types causing high energy shearing should be avoided. In the laboratory, adequate agitation can be provided on a continuous basis by a motor-driven propeller agitator. When the method is carried out continuously, rather than in batch, agitation can be provided by passing the blended crude through a succession of static mixers, with each additive being metered into the crude at a point upstream of one of the mixers. The static mixers are advantageously of the fixed in-line helical deflector type marketed by Kenics Corp., North Andover, Mass., USA, under the trademark KENICS.

For demonstration purposes with small quantities, the dewatered blended crude and all additives can be combined in a centrifuge tube, uniformity can be achieved by vigorous shaking, the blend can then be heated over a water bath, and phase separation accomplished by centrifuging. That procedure, however, does not provide advantages that can be gained by controlling the time of addition of the various additives, and superior results are achieved in the laboratory using a 3-neck flask equipped with a heating mantle, propeller agitator and thermometer, the dewatered blended crude first being placed in the flask, the alkalyzing agent then being introduced with continuous agitation, the emulsion destabilizing agent then being added after the pH has increased to at least 8, advantageously to at least 10, and the demulsifier then being introduced while agitation continues and after the emulsion destabilizing agent has been thoroughly distributed through the blended crude, heating advantageously being commenced when the crude is placed in the flask and being continued until the blend is transferred to centrifuge tubes.

As described in detail in aforementioned U.S. Pat. No. 4,466,885, the problem of obtaining clean phase separation is frequently complicated by production of an intermediate flocculated phase, occurring between the oil and water phases, the flocculated phase tending to be unstable so as to be as preferential for the oil as for the water. Though the demulsifiers used according to the invention reduce the deleterious effect of the intermediate flocculated phase, still cleaner and more rapid phase separation, with an increased yield of clean oil, can be achieved by also incorporating in the blend both produced water (water separated as free water from a raw crude) and a coagulating agent. Advantageously, filter alum is employed as the coagulating agent and is dissolved directly in the produced water. The produced water should amount to at least 3% of the volume of the dewatered blended crude being treated, and it is advantageous to preheat the solution of coagulating agent in produced water to at least the temperature of the blended crude before the solution is introduced. When produced water and a coagulating agent are employed, it is advantageous to have the demulsifying agent distributed through the blended crude immediately before or immediately after the produced water and coagulating agent are introduced.

The following examples are illustrative:

EXAMPLE 1

A representative demulsifier according to the invention is prepared using as the anionic surfactant an alkyl aryl sulfonate surfactant marketed under the trademark SIPONATE 330 by Alcolac Inc., Baltimore, Md, USA, using as the non-ionic surfactant an ethylene glycol distearate surfactant marketed under the trademark EMEREST 2355 by Emery Industries Ltd., Toronto, Ontario, Canada, and as the cationic surfactant a quaternary ammonium chloride surfactant marketed by Alcolac Inc. under the trademark ALACSAN QNA. The anionic surfactant is in liquid form, 90% active material by weight. The nonionic material is a particulate solid, 100% active material. The cationic material is liquid, 60% active material by weight. The emulsifier can be formulated in a conventional blending tank, with the following procedure suitable for making multiple barrel quantities. 690 gallons of xylene is first pumped into the tank, and with continual agitation, 207 lbs. of the solid ethylene glycol distearate product added incrementally over 30 minutes, blending until the liquid is completely clear. After observing that the blend remains clear, 690 lbs. of the alkyl aryl sulphonate material is added slowly and blending continued until completely solubilized. 483 lbs. of the cationic liquid surfactant is then added, taking care that gelling does not result. The finished demulsifier composition consists of 80% xylene, 9% of the active anionic surfactant material, 4.2% of the active cationic surfactant material, 3% of the active nonionic material and 3.8% diluents of the three commercial products, all by weight, and thus contains a total of 16.2% active surfactant material by weight.

EXAMPLE 2

By tests without employing the demulsifier according to this invention, it was determined that a particular Husky Aberfeldy fireflood crude could not be brought within pipeline specifications when using a reduced amount of ammonium bisulfite as the emulsion destabilizing additive. This crude, after blending with condensate and dewatering in the field, had a BS&W content of 27% by volume, a pH of 5.3 and an API gravity of 20.3.

To demonstrate the effectiveness of demulsifiers according to the invention, a mixture of 90 ml of the dewatered blended crude, 2 ml of a 10 molar aqueous sodium hydroxide solution, and 1.5 ml of the demulsifier composition of Example 1, diluted 1 part of the demulsifier composition to 10 additional parts by volume of xylene, was prepared in a 100 ml centrifuge tube. 0.75 ml of an aqueous 60% by weight solution of ammonium bisulfite was added and the tube shaken vigorously to achieve uniform distribution. 1.5 g. filter alum was dissolved in 5 ml of produced water, heated to 60° C. (140° F.) and the solution then added to the blend in the centrifuge tube. An additional 1 ml of 10 molar aqueous sodium hydroxide solution was then added and the tube shaken vigorously to assure a uniform blend. The tube and contents was then heated over a water bath at 64° C. (147.2° F.) for 20 hours. The blend was then allowed to settle on standing for 20 hours, with the tube then exhibiting an oil phase (68%), an intermediate emulsion phase (98%) and a solids-containing water phase (23%). The BS&W content of the oil phase was determined according to ANSI/ASTM D 96-73 and found to be nil.

EXAMPLE 3

Using the same equipment and general procedure as in Example 2, two treatments were carried out to compare the effectiveness of the demulsifier of Example 1 with that of the most effective commercially available demulsifier. In each treatment, the crude to be treated was taken from the same blended and dewatered Husky Aberfeldy fireflood crude taken from a lot delivered from the field on one day, this Aberfeldy crude having an API gravity of 20.3, a BS&W content of 27% by volume and a pH of 5.3. Produced water was employed and in each case was taken from a single lot obtained by dewatering Aberfeldy crude and having a pH of 4.9. In each case, there was added in succession to a 100 ml tapered centrifuge tube 90 ml of the crude, 1.0 ml of an aqueous 10 molar solution of sodium hydroxide, 2.0 ml of the respective demulsifier, 1.5 ml of an aqueous 60% solution of ammonium bisulfite, a solution of 0.15 g. of filter alum in 5 ml of the produced water, with the solution preheated to 60° C., and an additional 1 ml of 10 molar sodium hydroxide, the centrifuge tube then being shaken vigorously to assure a uniform blend and heated over a water bath at 64° C. for 20 hours. In each case, the demulsifier was diluted 1:10 with xylene. In the run with the demulsifier of Example 1, centrifuging provided an oil phase of 73%, an intermediate flocculated phase of 7% and a solids-containing water phase of 20%, and the oil phase was found to have a BS&W content of nil when the sample was taken at the 85 ml level and of 0.3% by volume when the sample was taken at the 40 ml level, so that the BS&W content for the entire oil phase was signifantly less than 0.3% by volume. In the run with the commercially available demulsifier, centrifuging provided an oil phase of 75%, an intermediate flocculated phase of 21%, a water phase of 3% and a solids phase of 1%, and the oil phase was found to have a BS&W content of 0.3% by volume for a sample taken at the 85 ml level and of 0.7% by volume for a sample taken at the 40 ml level, so that the BS&W content for the entire oil phase was between 0.3 and 0.7% by volume. While, considering the high initial BS&W content of 27% by volume in a crude known to be difficultly treatable, the results of both runs are favorable, it is significant that the BS&W content of the clean oil obtained with the demulsifier of Example 1 was substantially lower and that the volume of the flocculated intermediate phase obtained with that demulsifier was only ⅓ that of the flocculated intermediate phase resulting when the commercially available demulsifier was used.

The commercially available demulsifier employed in Example 3 was CHAMPION BX6079, supplied by Champion Chemical Co., Edmonton, Alberta, Canada.

What is claimed is:

1. The method for removing inorganic particulate solids and water from a heavy crude oil obtained by an enhanced recovery procedure and which has a BS&W content in excess of pipeline specifications including a significant proportion of water present as the disperse phase of a water-in-oil emulsion, the heavy crude oil having been blended with a compatible hydrocarbon diluent to provide an API gravity of at least 17, comprising treating the blended crude to destabilize the water-in-oil emulsion wherein said treating step is accomplished by adjusting the pH of the crude to at least 8, and uniformly distributing throughout the crude a small proportion of at least one additive selected from the group consisting of alkali metal, alkaline earth metal and ammonium hydrosulfites, hydrosulfides and monosulfides, the amount of the at least one additive being in the range of from a few hundreths of a percent to several percent of the weight of the blended crude;

providing in uniform distribution throughout the crude so treated with a demulsifier composition comprising an anionic surfactant which is soluble in oil, a nonionic surfactant which is insoluble in water and dispersible in oil, and a cationic surfactant which is soluble in water, the anionic surfactant constituting 5–20 parts by weight and the nonionic and cationic surfactants each constituting 2–10 parts by weight of the demulsifier composition, the amount of the demulsifier composition distributed throughout the crude being such that the total surfactant weight equals 50–300 grams per barrel of blended crude;

separating the resulting crude into at least an oil phase and a water phase; and recovering the oil phase as clean blended crude having a BS&W content within pipeline specifications.

2. The method according to claim 1, wherein the anionic surfactant is at least one alkyl aryl sulphonate.

3. The method according to claim 1, wherein the nonionic surfactant is ethylene glycol distearate.

4. The method according to claim 1, further comprising the step of maintaining the resulting treated crude at 52°–88° C. (125°–190° F.) for at least a few minutes before the phase separation of the crude.

5. The method according to claim 1, wherein a small amount of an acid-reacting coagulating agent and an amount of produced water equal to at least 3% of the volume of the blended dewatered crude are incorporated while the blend is at a pH of at least 8.

6. The method according to claim 1, wherein the at least one additive comprises ammonium bisulfite.

* * * * *